US007806057B2

(12) United States Patent
Early

(10) Patent No.: US 7,806,057 B2
(45) Date of Patent: Oct. 5, 2010

(54) HOPPER CAR GATE WITH OPPOSED DOUBLE DOORS

(75) Inventor: Stephen R. Early, Olathe, KS (US)

(73) Assignee: Aero Transportation Products, Inc., Independence, MO (US)

( * ) Notice: Subject to any disclaimer, the term of this patent is extended or adjusted under 35 U.S.C. 154(b) by 333 days.

(21) Appl. No.: 11/824,900

(22) Filed: Jul. 3, 2007

(65) Prior Publication Data

US 2009/0007813 A1 Jan. 8, 2009

(51) Int. Cl.
*B61D 3/00* (2006.01)

(52) U.S. Cl. ..... 105/253; 105/255; 105/247; 105/280; 105/282.1

(58) Field of Classification Search ..... 105/253, 105/247, 280, 282.1–282.3
See application file for complete search history.

(56) References Cited

U.S. PATENT DOCUMENTS 3,110,270 A * 11/1963 Ingram ..... 105/253
3,133,509 A * 5/1964 Farmer ..... 105/253
3,138,116 A * 6/1964 Dorey ..... 105/253
3,255,553 A * 6/1966 Dorey ..... 105/282.1
3,255,714 A * 6/1966 Dorey ..... 105/253
3,344,748 A * 10/1967 Dorey ..... 105/282.1
3,348,501 A * 10/1967 Stevens et al. ..... 105/248
3,450,064 A * 6/1969 Floehr et al. ..... 105/282.1
3,577,680 A * 5/1971 Nagy ..... 49/358
3,581,673 A * 6/1971 Danielson ..... 105/253
3,611,947 A * 10/1971 Nagy ..... 105/253
3,631,812 A * 1/1972 Winslow, Jr. ..... 105/240
3,709,152 A * 1/1973 Gutridge ..... 105/253
3,780,672 A * 12/1973 Fuller ..... 105/253
3,831,803 A * 8/1974 Hutchison et al. ..... 220/378
3,837,294 A * 9/1974 Fossett ..... 105/253
4,009,906 A * 3/1977 Sweet et al. ..... 298/27
4,236,458 A * 12/1980 Varda ..... 105/310.2
4,574,989 A * 3/1986 Pole ..... 222/486
6,412,421 B2 * 7/2002 Dohr et al. ..... 105/282.2
6,412,422 B2 * 7/2002 Dohr et al. ..... 105/282.3
6,637,346 B2 10/2003 Gaydos
6,736,072 B2 * 5/2004 Degelman et al. ..... 105/258
6,932,433 B2 * 8/2005 Heider et al. ..... 298/27
7,124,693 B2 * 10/2006 Lucas ..... 105/282.2
2005/0081741 A1 * 4/2005 Fortuna ..... 105/280
2005/0166788 A1 * 8/2005 Early ..... 105/247
2005/0263031 A1 * 12/2005 Early ..... 105/247
2009/0007813 A1 * 1/2009 Early ..... 105/253

OTHER PUBLICATIONS

U.S. Appl. No. 12/077,899, Stephen R. Early.
U.S. Appl. No. 12/265,117, Stephen R. Early.

* cited by examiner

*Primary Examiner*—S. Joseph Morano
*Assistant Examiner*—Jason C Smith
(74) *Attorney, Agent, or Firm*—Stinson Morrison Hecker LLP

(57) ABSTRACT

A hopper car gate with opposed double doors for discharging cargo from a hopper car. The gate has joined side walls and end walls which present top and bottom openings. A flange joined to the walls adjacent the top opening is adapted to be joined to the hopper car. A rail extends between opposite walls adjacent the bottom opening. First and second doors are supported on the rail. The doors are moveable in opposite directions between a closed position which blocks the bottom opening and an open position which allows the cargo to exit through the opening.

21 Claims, 6 Drawing Sheets

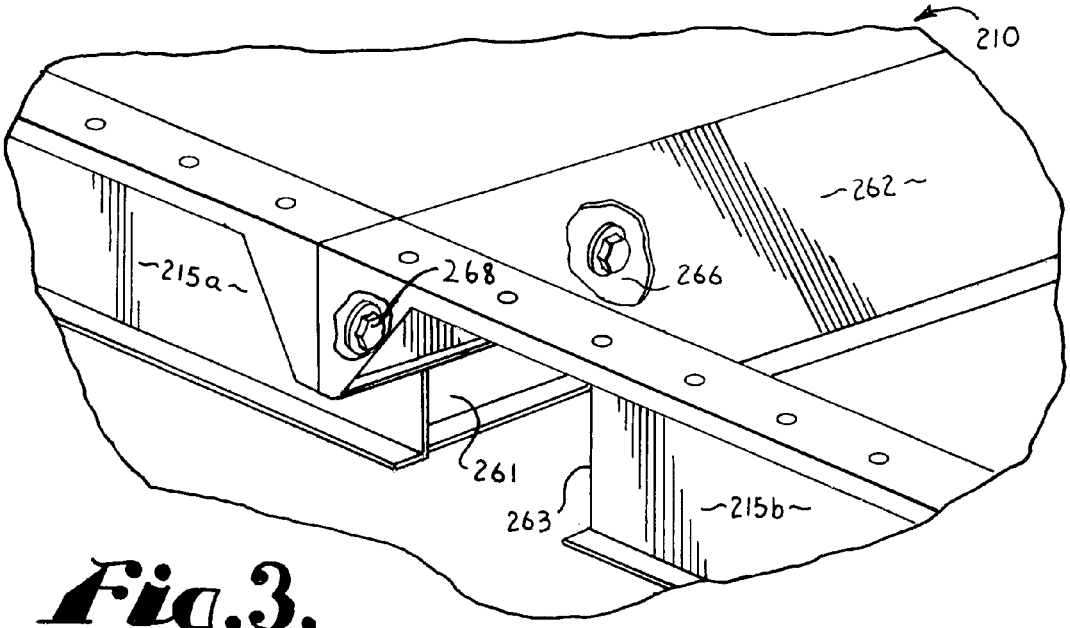
Fig.3.
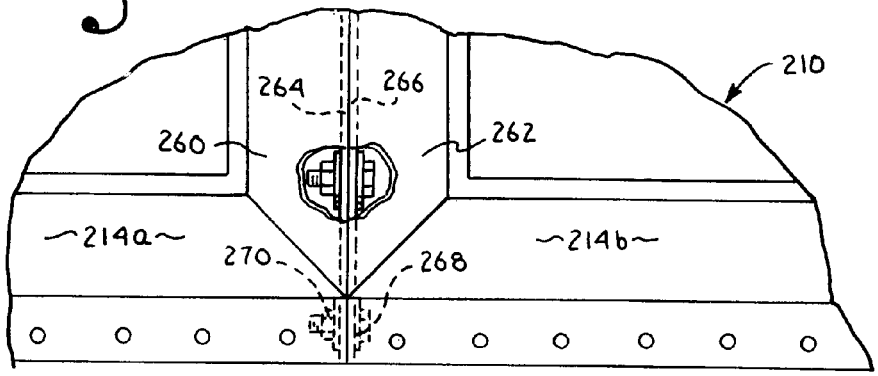
Fig.4.
Fig.5.
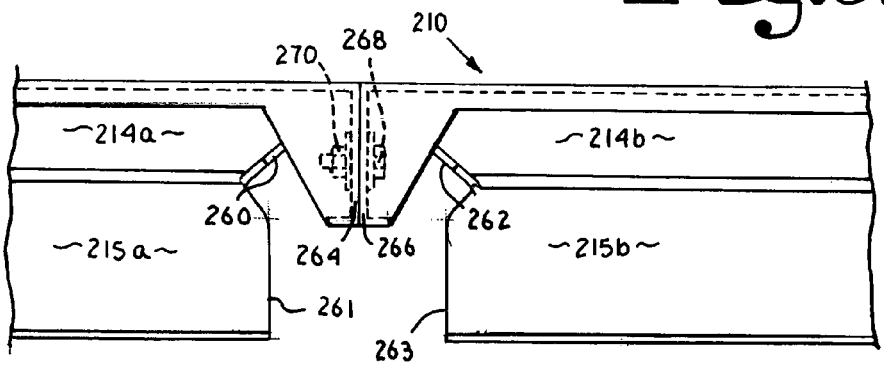

HOPPER CAR GATE WITH OPPOSED DOUBLE DOORS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention is related in general to a hopper car for carrying bulk materials and more particularly to a hopper car gate with opposed double doors.

2. Description of Related Art

Hopper cars are commonly used to transport and sometimes store bulk materials. Hopper cars include one or more hoppers which hold bulk materials or other cargo for shipment. Each hopper has a discharge opening at its bottom in order to discharge the cargo upon arrival at its intended destination. A gate is joined to each opening to control the discharge of cargo from the hopper. Typically, the gate will have a frame defining an opening and a door moveable between a closed position which blocks the opening and an open position which allows cargo to exit through the opening. An opening mechanism allows a user to move the door between its closed and open positions.

Some commonly transported bulk materials have difficulty exiting through standard hopper gates. In particular, dried distillers' grains, which are a byproduct of ethanol production from corn, are sticky and may form clumps blocking the opening of a standard hopper gate. A bigger discharge opening is needed to effectively discharge sticky cargo such as dried distillers' grains. Increasing the discharge opening on a standard hopper gate presents a problem because of the increased cargo load supported by the door. This increase in cargo load translates into an increase in operating torque necessary to open the door. The operating torque cannot be increased beyond levels making it impractical to operate the door. Additionally, the Association of American Railroads (AAR) sets industry standards regulating the maximum amount of breakaway torque required to open a hopper door. Therefore, there is a need for a hopper car gate which can effectively discharge sticky bulk materials while having a practical operating torque.

BRIEF SUMMARY OF THE INVENTION

The present invention is directed toward a hopper car gate with opposed double doors for discharging cargo from a hopper car. The hopper car has one or more hoppers, each having an opening and a rim surrounding the opening. The hopper car gate is joined to the rim surrounding the opening.

In a preferred embodiment, the hopper car gate has opposed generally upright side walls and opposed generally upright end walls joined to the side walls. The joined walls present a top opening and a bottom opening. A flange is joined with the side and end walls adjacent the top opening, and the flange is adapted to be joined to the rim surrounding the hopper's opening. A rail extends between opposite walls adjacent the bottom opening. The rail supports first and second doors that are moveable in opposite directions. The doors move between a closed position which blocks the bottom opening and an open position which allows the cargo to exit through the bottom opening. Thus, the gate of the present invention presents a larger discharge opening than prior art constructions for easy discharge of all bulk materials. Further, having two doors reduces the amount of cargo load supported by each door which reduces the amount of operating torque necessary to open and close each door.

The doors may have mating beveled edges to insure a tight fit and prevent cargo from "leaking" through the bottom opening when the doors are in the closed position. A cover may extend between opposite walls and overlie the adjacent leading edges of the doors when the doors are in the closed position. In an alternative embodiment, an extension may be mounted to the bottom surface of a second door such that when the doors are in a closed position the extension extends underneath the first door. Alternatively, the doors may overlap when in a closed position. In another embodiment, the bottom opening may present first and second discharge outlets separated by first and second dividing walls extending between the side walls. A first door blocks the first discharge outlet when in a closed position and a second door blocks the second discharge outlet when in a closed position. The dividing walls may have mating surfaces which are rigidly joined.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

BRIEF DESCRIPTION OF THE DRAWINGS

FIG. 3 is a fragmentary perspective view, with portions broken away, of an alternative embodiment of the gate according to the present invention, showing dividing walls with joined mating surfaces;

FIG. 4 is a fragmentary top plan view, with portions broken away, of the gate of FIG. 3;

FIG. 5 is a fragmentary side elevational view of the gate of FIG. 3;

DETAILED DESCRIPTION OF PREFERRED EMBODIMENT

Figure 1:
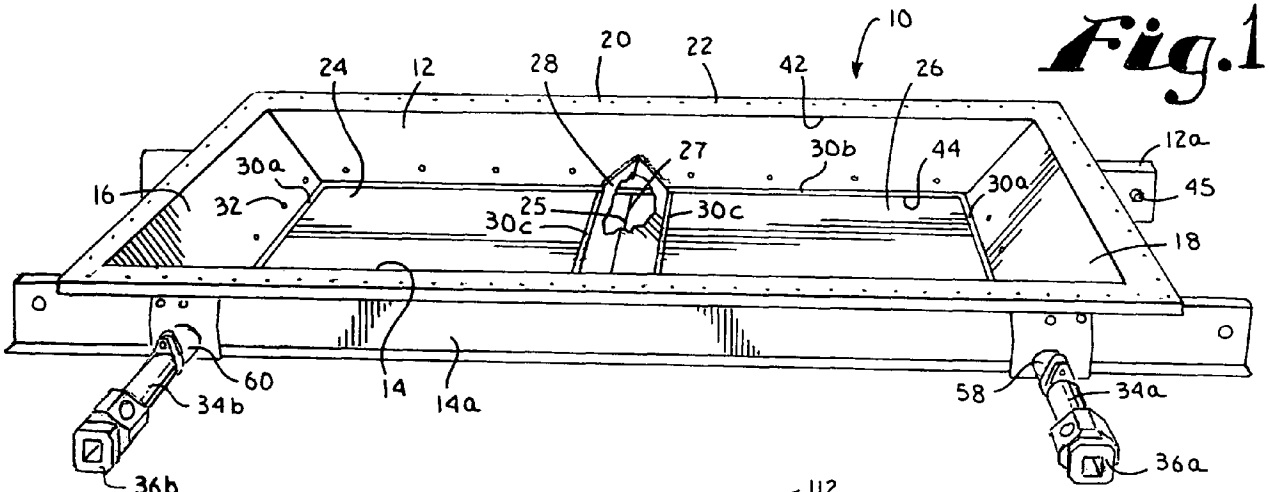
FIG. 1 is a perspective view of one embodiment of a hopper car gate, with portions broken away, with opposed double doors.

A hopper car gate 10 with opposed double doors is depicted in FIG. 1. Gate 10 has opposed generally upright side walls 12 and 14 joined with opposed generally upright end walls 16 and 18. The joined walls present a top opening 42 and a bottom opening 44 which is slightly smaller than top opening 42 because of the angle of the walls. Frame members 12*a* and 14*a* support and are joined with side walls 12 and 14. A flange 20 is joined with side walls 12, 14 and end walls 16, 18 adjacent opening 42. The flange has equidistant spaced openings 22 which receive fasteners to join the gate to a hopper car. The gate has a first door 24 blocking a portion of bottom opening 44 and a second door 26 also blocking a portion of bottom opening 44. FIG. 1 depicts the doors in a closed position. The gate 10 has a cover 28 extending between side walls 12 and 14. The cover 28 overlies the adjacent leading edges 25, 27 of doors 24, 26 when the doors are in the closed position. A flexible seal 30*a* is mounted to each end wall 16 and 18 with equidistant spaced fasteners 32. Likewise, a flexible seal 30*b* is mounted to each side wall 12 and 14, and flexible seals 30*c* are mounted to cover 28. Seals 30*a-c* prevent cargo from leaking through opening 44 when the doors are in the closed position.

Figure 12:
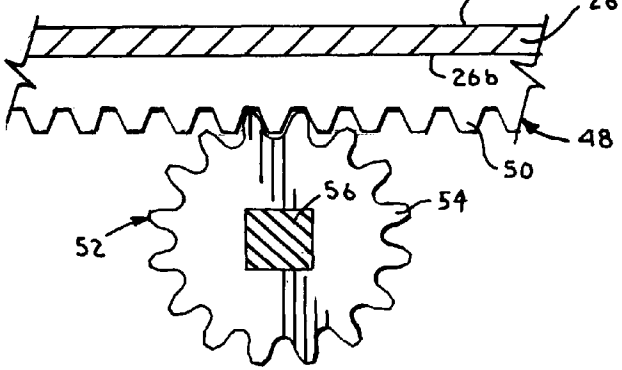
FIG. 12 is a fragmentary cross-sectional view of the gate of FIG. 1, showing a rack mounted to the bottom surface of a door and a gear engaged with the rack.

As depicted in FIG. 12, door 26 has a top surface 26*a* and a bottom surface 26*b*. A gear rack 48 is mounted on bottom surface 26*b*. The rack extends the length of the door in a direction parallel to the direction of movement of the door. The rack has a plurality of teeth, one of which is designated as 50. A gear 52 has a plurality of gear teeth, one of which is designated as 54, that are successively engageable with the rack teeth. The gear 52 is mounted on a shaft 56. Although as depicted the gear rack is mounted to the bottom surface of the door, it is within the scope of the invention for the gear rack to be mounted on the top surface of the door.

As depicted in FIG. 1, a bearing sleeve 58 extends out of frame member 14*a*. A coaxial shank 34*a* is received within sleeve 58. The shank has an integral socket 36*a* at its outer end. The shaft 56, depicted in FIG. 12, is secured to shank 34*a* such that it rotates with shank 34*a* and socket 36*a*. Sleeve 58 houses a bearing (not shown) which prevents deflection of shaft 56. When socket 36*a* is rotated clockwise, shank 34*a*, shaft 56, and gear 52, depicted in FIG. 12, also rotate clockwise. The clockwise rotation of gear 52 drives rack 48 to the right, thereby sliding door 26 from its closed position to an open position. When socket 36*a* is rotated counter-clockwise, gear 52 drives rack 48 to the left, thereby sliding door 26 from its open position to its closed position. A sleeve extending out of frame member 12*a* receives a shank that is connected to shaft 56. Thus, the shaft 56 extends between frame members 12*a* and 14*a* in a direction perpendicular to the movement of the door. A socket may also be connected to the shank extending from frame member 12*a* to provide a coupling for either a manual or power tool to open and close the door.

Door 24 has a similar opening mechanism as described above for door 26. A sleeve 60 extends from frame member 14*a* and receives shank 34*b*. The shank has an integral socket 36*b* at its outer end. A gear rack, like that depicted in FIG. 12, is mounted on the bottom surface of door 24, and the rack is engaged by a gear that is mounted on a shaft which rotates with socket 36*b*. However, socket 36*b* is rotated in a counter-clockwise direction to open door 24. Thus, the doors are moveable in opposite directions between the closed position in which they block opening 44 and the open position in which they allow cargo to exit through the opening.

Figure 13:
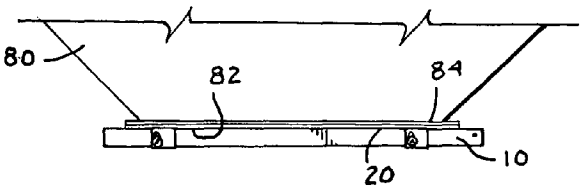
FIG. 13 is a fragmentary side elevational view showing the gate of FIG. 1 joined to the rim surrounding a hopper opening.

FIG. 13 depicts gate 10 joined with cargo containing hopper 80. Hopper 80 has an opening 82 and a rim 84 surrounding the opening. Flange 20 is joined to rim 84. Preferably, rim 84 has a plurality of openings (not shown) which align with openings 22 on flange 20. The aligned openings receive fasteners which secure the gate to the hopper.

Figure 2:
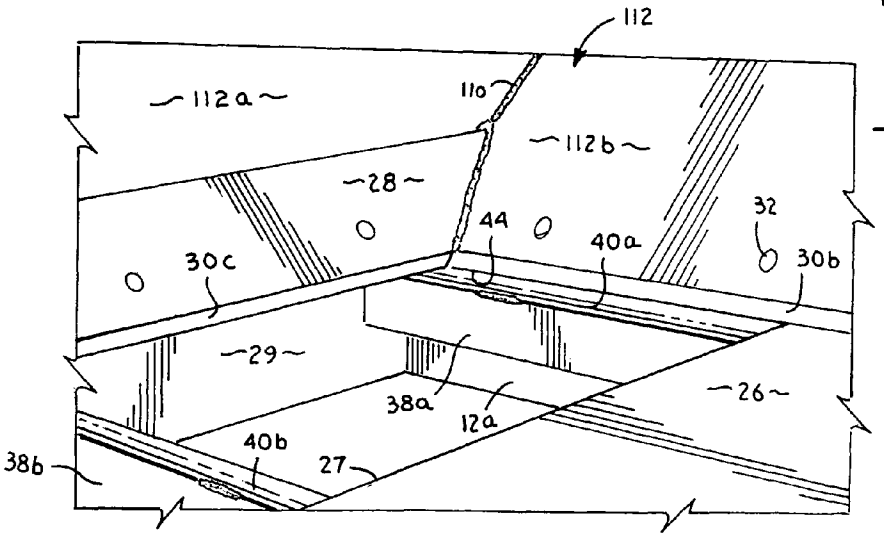
FIG. 2 is a fragmentary perspective view of an alternative embodiment of the gate according to the present invention, having two sections joined by welding.
Figure 6:
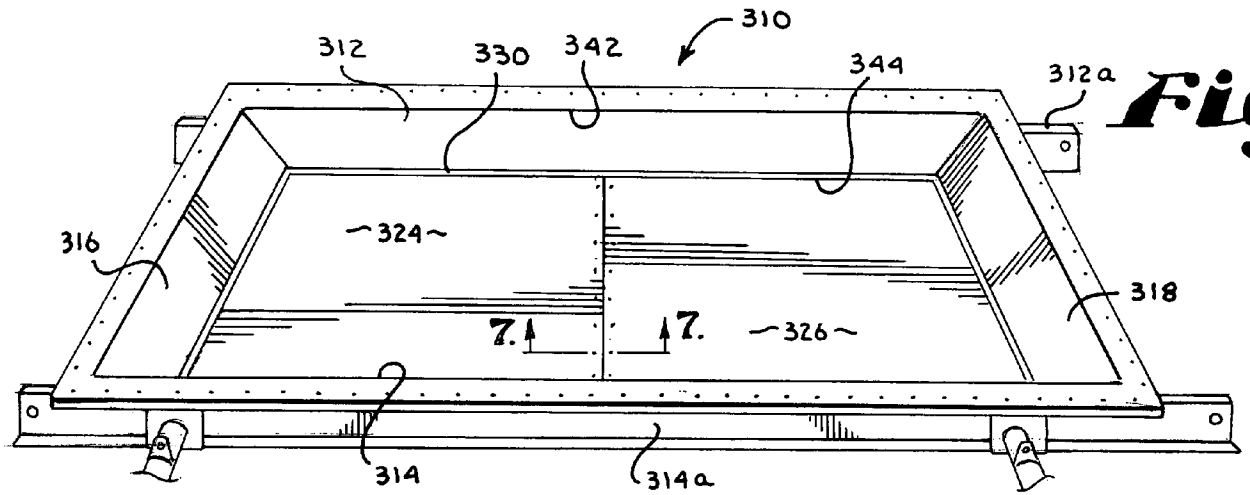
FIG. 6 is a perspective view of an alternative embodiment of the gate according to the present invention, showing doors with mating beveled edges.

The gate depicted in FIG. 2 is identical to that depicted in FIG. 1 except that each side wall and frame member is formed from first and second sections. Side wall 112 is depicted with first and second sections 112*a*, 112*b* which are joined by weld 110. The sections are joined at a location that is aligned with the leading edges of the doors when the doors are in a closed position. The side wall which is opposite wall 112 is also formed from first and second sections joined by welding. Door 26 is depicted in a partially open position. Door 26 is supported by rail 38*a*, which is located below seal 30*b*, and rail 38*b*, which is located along the center of opening 44. The door is also supported by a third rail which is on the opposite side of the opening from rail 38*a*. A center wall 29 extends between frame members 12*a* and 14*a* underneath cover 28. Rails 38*a* and 38*b* extend from end wall 18 to center wall 29 adjacent bottom opening 44. There are also three rails extending from center wall 29 to end wall 16 to support door 24. While as depicted the gates of FIGS. 1 and 2 have a center wall 29, it is within the scope of the invention for the gates to not have a center wall. In this alternative embodiment, there are three rails that support both doors and extend between opposite end walls adjacent the bottom opening.

Circular rods 40*a* and 40*b* are welded to the top of the rails. The rods 40*a* and 40*b* facilitate the opening of door 26. The rods may be made of bronze or a similar material which generates a relatively low amount of friction with the door. A pin 45, depicted in FIG. 1, extends from frame member 12*a* and supports door 26 when the door is in an open position, and a similar pin extends from frame member 14*a* to support door 26. Pins also support door 24 when the door is in an open position.

Figure 11:
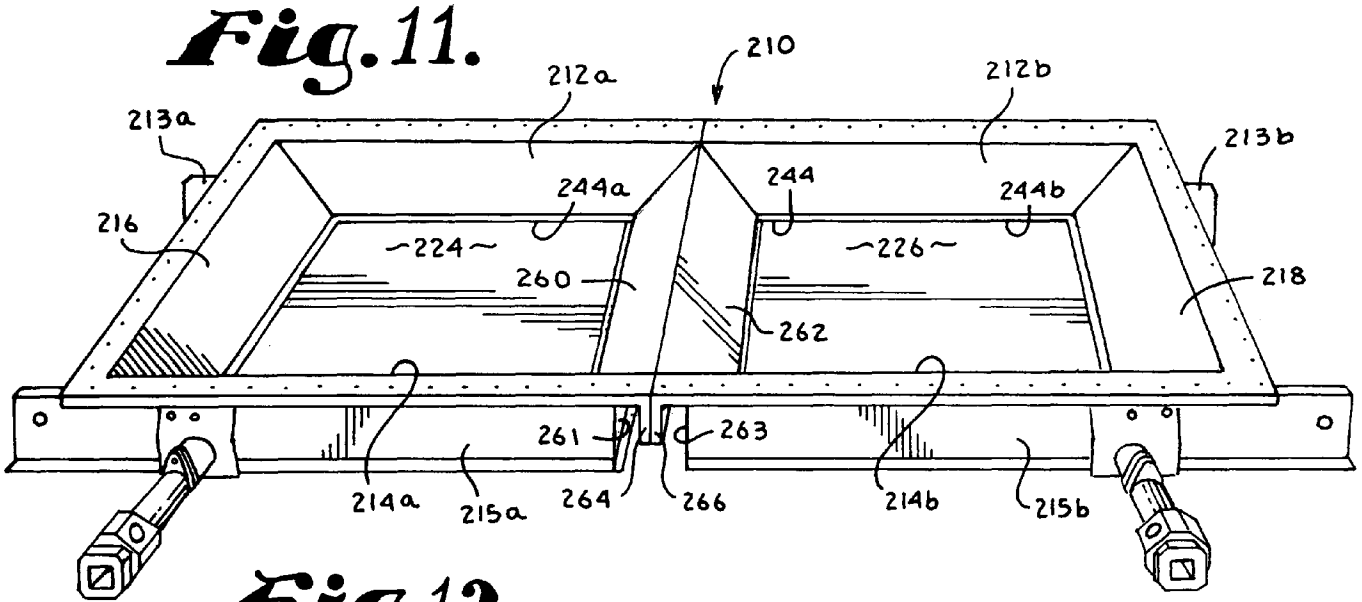
FIG. 11 is a perspective view of the gate of FIGS. 3-5.

FIG. 11 depicts a gate 210 with a bottom opening 244 presenting a first discharge outlet 244*a* and a second discharge outlet 244*b*. The gate has first and second end walls 216 and 218 joined with side walls 212*a-b* and 214*a-b*. Frame members 213*a* and 215*a* support and are joined with side walls 212*a* and 214*a*. Likewise, frame members 213*b* and 215*b* support and are joined with side walls 212*b* and 214*b*. A first dividing wall 260 extends between side walls 212*a* and 214*a*, and a second dividing wall 262 extends between side walls 212*b* and 214*b*. A first center frame 261 supports and is joined with first dividing wall 260. First center frame 261 extends between frame members 213*a* and 215*a*. A second center frame 263 supports and is joined with second dividing wall 262. Second center frame 263 extends between frame members 213*b* and 215*b*. The gate has a first door 224 depicted in a closed position blocking first discharge outlet 244*a* and a second door 226 depicted in a closed position blocking second discharge outlet 244*b*.

As depicted in FIGS. 4 and 5, a surface 264 extends down from the top of dividing wall 260 and a surface 266 extends down from the top of dividing wall 262. Mating surfaces 264 and 266 have a plurality of equidistant aligned openings which receive bolts, one of which is depicted as 268 in FIGS. 3-5. A nut 270 is threaded on bolt 268. Dividing wall 260 opposes end wall 216, and dividing wall 262 opposes end wall 218. Side walls 212*a* and 214*a*, first end wall 216, and first dividing wall 260 present first discharge outlet 244*a*. Side walls 212*b* and 214*b*, second end wall 218, and second dividing wall 262 present second discharge outlet 244*b*. Gate 210 has a similar opening mechanism as the embodiment depicted in FIGS. 1 and 12. The gate may also be joined to a hopper as described in connection with the embodiment depicted in FIGS. 1 and 13.

FIGS. 6-10 depict a gate 310 having doors 324 and 326 with mating beveled edges 324*b* and 326*b*. The mating edges prevent cargo from leaking through the doors when they are in a closed position. The gate has side walls 312 and 314 joined with end walls 316 and 318. The joined walls present a top opening 342 and bottom opening 344. Frame members 312*a* and 314*a* support and are joined with side walls 312 and 314. A flexible seal 330 is mounted to the walls around the perimeter of opening 344 in the same manner as the embodiment depicted in FIG. 1. Doors 324 and 326 are in a closed position in which they block opening 344. The doors are moveable in opposite directions between the closed position depicted in FIG. 6 and an open position depicted in FIG. 9 which allows cargo to exit through opening 344. Gate 310 has a similar opening mechanism as the embodiment depicted in FIGS. 1 and 12. The gate may also be joined to a hopper as described in connection with the embodiment depicted in FIGS. 1 and 13.

Figure 9:
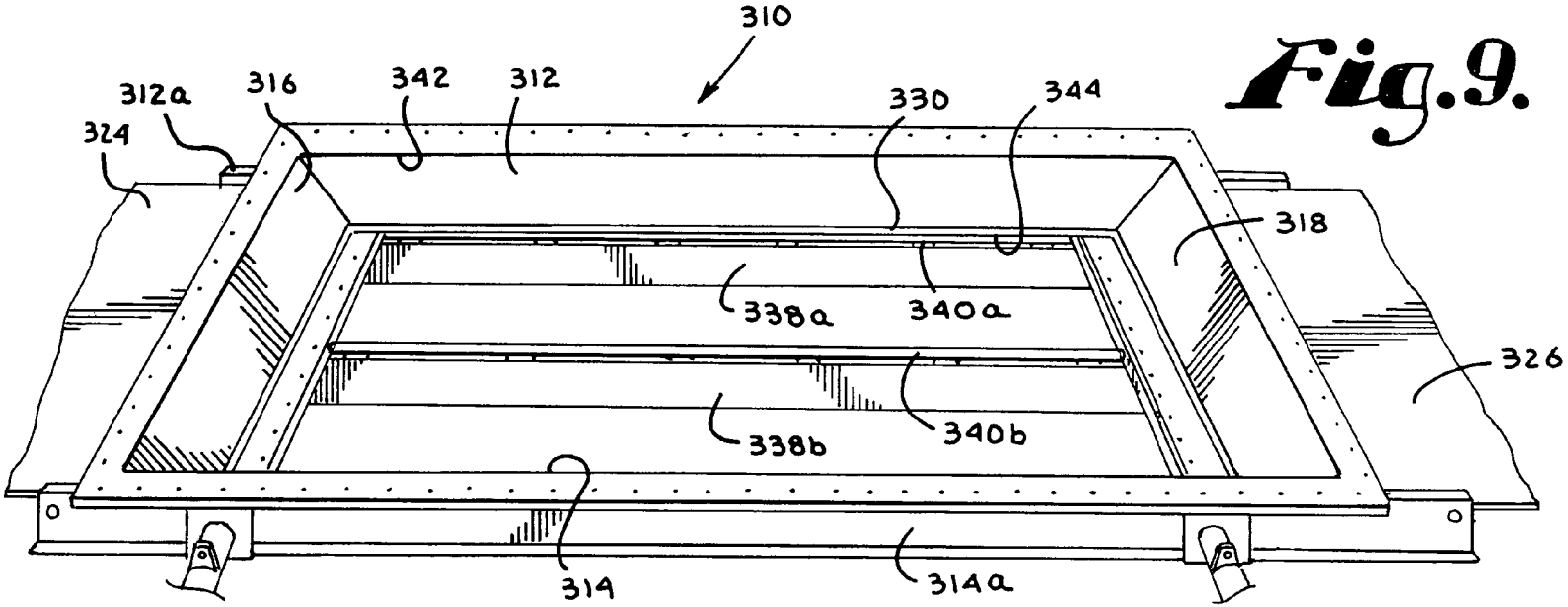
FIG. 9 is a perspective view of the gate of FIG. 6 with the doors in an open position.

As depicted in FIG. 9, gate 310 has rails 338*a* and 338*b* which extend between walls 316 and 318 adjacent opening 344. The rails 338*a-b* extend in a direction parallel to the direction of movement of doors 324 and 326. Rail 338*a* is positioned below seal 330, while rail 338*b* extends down the middle of opening 344. There is also a third rail positioned below the seal which is hidden by wall 314 in FIG. 9. The three rails support doors 324 and 326. Rods 340*a* and 340*b* are welded to the top of rails 338*a-b*. Doors 324 and 326 have bottom surfaces 324*c* and 326*c*, as depicted in FIG. 7, which slide along rods 340*a* and 340*b*.

Figure 8:
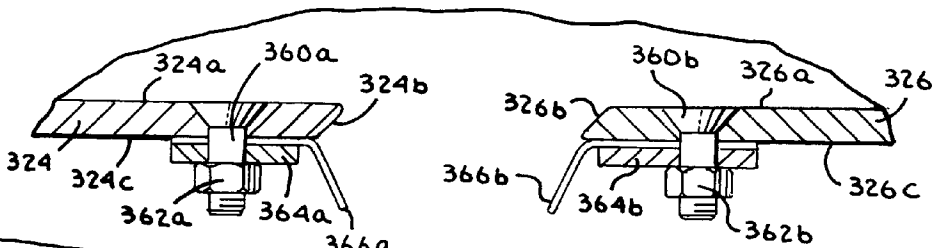
FIG. 8 is a cross-sectional view similar to FIG. 7 except that the doors are in an open position.
Figure 7:
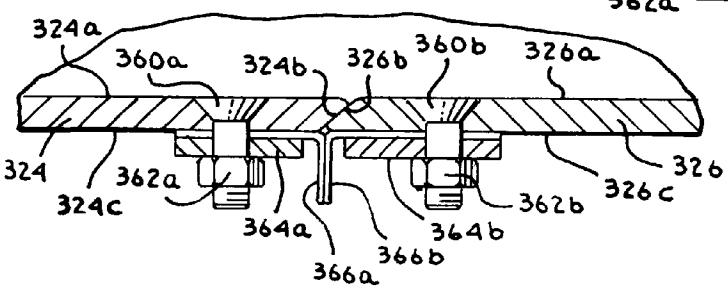
FIG. 7 is a cross-sectional view taken along the line 7-7 of FIG. 6 showing the doors in a closed position.
Figure 10:
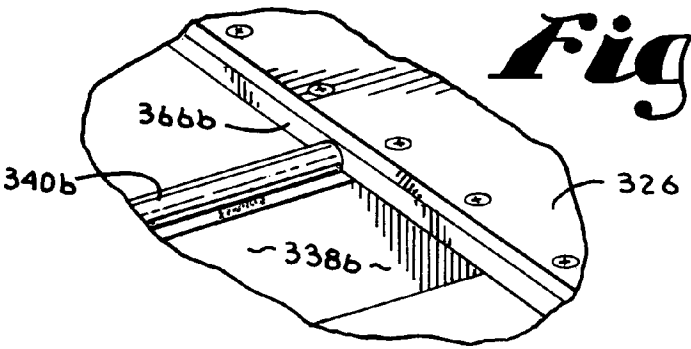
FIG. 10 is an enlarged perspective view of the gate of FIG. 6, showing the door supported by a rail.

FIG. 7 depicts doors 324 and 326 in the closed position. The doors have mating beveled edges 324*b* and 326*b*. Door 324 has a top surface 324*a* and a bottom surface 324*c*. A flexible seal 366*a* is mounted on bottom surface 324*c* adjacent beveled edge 324*b*. A bolt 360*a* and a nut 362*a* secure seal 366*a* to the door via a mounting plate 364*a*. The seal on door 326 is similarly mounted. Door 326 has a top surface 326*a* and a bottom surface 326*c*. A flexible seal 366*b* is mounted on bottom surface 326*c* adjacent beveled edge 326*b*. A bolt 360*b* and a nut 362*b* secure seal 366*b* to the door via a mounting plate 364*b*. As depicted in FIG. 7, seals 366*a* and 366*b* engage when doors 324 and 326 are in the closed position. When the doors are in the open position, as depicted in FIG. 8, seals 366*a* and 366*b* extend away from beveled edges 324*b* and 326*b*. FIG. 10 depicts door 326 supported by rail 338*b* and rod 340*b*. Flexible seal 366*b* fits around rod 340*b* so door 326 can slide smoothly along the rod. The flexible seal also fits around the other rods to ensure smooth sliding. Seals 366*a* and 366*b* are preferably constructed from UHMW polyethylene, but other types of materials are within the scope of the invention.

Figure 14:
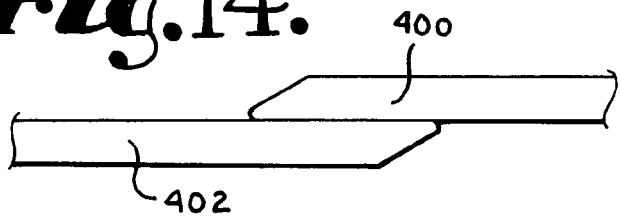
FIG. 14 is a side elevational view of an alternative embodiment of the gate according to the present invention, showing overlapping doors.

FIG. 14 depicts an alternative embodiment of the gate of FIGS. 6-10. The gate has first and second doors 400 and 402 shown in the closed position. Doors 400 and 402 overlap when in the closed position to prevent cargo from leaking through the doors. In this embodiment the rails may be higher under first door 400 than under second door 402 such that first door 400 overlaps second door 402 when in a closed position. A wiper seal, preferably constructed from UHMW polyethylene, may also be affixed to the bottom surface of first door 400 to prevent cargo from leaking through the doors when in a closed position.

Figure 15:
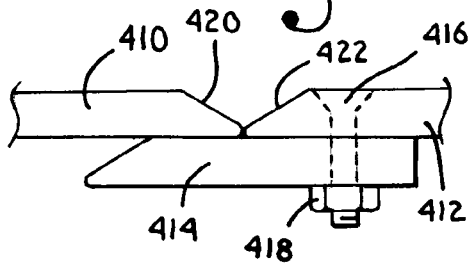
FIG. 15 is a side elevational view of an alternative embodiment of the gate according to the present invention, showing an extension mounted to the bottom surface of a door.

FIG. 15 depicts an alternative embodiment of the gate of FIGS. 6-10. The gate has first and second doors 410 and 412 with leading edges 420 and 422 that are adjacent when the doors are in the closed position. An extension 414 is mounted to the bottom surface of second door 412 with bolt 416 and nut 418. Extension 414 extends underneath first door 410 to prevent cargo from leaking through the doors when the doors are in the closed position.

In operation, a person wishing to open gate 10, depicted in FIGS. 1, 12, and 13, inserts an opening tool in sockets 36*a-b* with the capability to rotate the sockets. Socket 36*a* is rotated in a clockwise direction to open door 26 and socket 36*b* is rotated in a counter-clockwise direction to open door 24. Shaft 56, as depicted in FIG. 12, rotates in a clockwise direction due to its connection with socket 36*a* via shank 34*a*. Gear 52, which is mounted on shaft 56, rotates in a clockwise direction and drives gear rack 48 to the right, thereby sliding door 26 to its open position. The counter-clockwise rotation of socket 36*b* causes the opening mechanism associated with door 24 to move the door to its open position. When doors 24 and 26 are moved to an open position, the cargo contained within hopper 80, depicted in FIG. 13, is released from the hopper. After the cargo is released from the hopper, socket 36*a* is rotated in a counter-clockwise direction to close door 26, and socket 36*b* is rotated in a clockwise direction to close door 24. The gates depicted in FIGS. 2-11 operate in the same manner as gate 10 depicted in FIGS. 1, 12, and 13.

From the foregoing it will be seen that this invention is one well adapted to attain all ends and objectives herein-above set forth, together with the other advantages which are obvious and which are inherent to the invention. Specifically, the gate of this invention has an opening which is 50 to 100% larger than the prior art. The larger opening allows for the easy passage of any type of bulk materials typically carried within a hopper. Further, the dual door design of the gate makes it possible to open the doors with a practical operating torque.

Since many possible embodiments may be made of the invention without departing from the scope thereof, it is to be understood that all matters herein set forth or shown in the accompanying drawings are to be interpreted as illustrative, and not in a limiting sense. The bottom openings of the gates shown in FIGS. 1, 2, 6 and 11 are smaller than the respective top openings of the gates, however, it is within the scope of the invention for the bottom openings to have the same size as or be larger than the top openings. The openings on the flanges of the gates shown in FIGS. 1, 2, 6 and 11 are generally equidistant, but it is within the scope of the invention for the openings to be spaced in a different manner. The gate shown in FIG. 6 may also have a cover extending between its side walls and overlying the leading edges of the doors when the doors are in a closed position. The openings on the mating surfaces of the gate shown in FIGS. 3-5 and 11 are generally equidistant, but it is within the scope of the invention for the openings to be spaced in a different manner. Also, while the dividing walls of the gate depicted in FIGS. 3-5 and 11 are shown joined with nuts and bolts, the walls may be joined by welding, with rivets, wedge clamps, a hinge pin or pins, or any other joining means known in the art. Further, while FIG. 12 only depicts one gear and one gear rack, it is understood that there may be multiple gears mounted on the shaft extending between the side walls, and multiple gear racks engaged with the gears.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A hopper car gate for discharging cargo from a hopper car, said car comprising a hopper having an opening and a rim surrounding said opening, said gate comprising:

opposed generally upright side walls;

opposed generally upright end walls joined to said side walls, wherein said joined walls present a top opening and a bottom opening;

a flange joined with said side and end walls adjacent said top opening and adapted to be joined to the rim of the car;

a rail extending between opposite walls adjacent said bottom opening;

first and second doors supported on said rail, said doors horizontally slideable on said rail in opposite directions between a closed position which blocks said bottom opening and an open position which allows the cargo to exit through said bottom opening, wherein each of said doors presents top and bottom surfaces;

first and second racks, each of which is mounted on said bottom surface of one of said doors, each of said racks extending in a direction parallel to the direction of movement of said doors and presenting multiple rack teeth;

first and second drive shafts, each of which extends between opposite walls in a direction perpendicular to the direction of movement of said doors;

first and second gears, each of which is mounted on one of said drive shafts for rotation thereby, each of said gears having a plurality of gear teeth successively engageable with said rack teeth on one of said racks; and first and second sockets, each of which is coupled with one of said first and second drive shafts, wherein said first and second doors move when said first and second sockets, respectively, are rotated.

2. The gate of claim 1, wherein said doors present leading edges which are adjacent when said doors are in said closed position, and wherein a cover extends between opposite walls and overlies said leading edges when said doors are in said closed position.

3. The gate of claim 1, wherein said doors present mating beveled edges which prevent cargo from exiting said bottom opening when said doors are in said closed position.

4. The gate of claim 3, wherein said doors present top and bottom surfaces and further comprising flexible seals mounted on said bottom surfaces adjacent said beveled edges, wherein said seals engage when said doors are in said closed position.

5. The gate of claim 1, wherein said doors present leading edges which are adjacent when said doors are in said closed position, wherein said doors present top and bottom surfaces, and further comprising an extension mounted to said bottom surface of said second door, said extension extending underneath said first door when said doors are in said closed position.

6. The gate of claim 1, wherein said doors overlap when in said closed position.

7. The gate of claim 1, further comprising first and second frame members, each of which supports and is joined with one of said side walls, and a center wall extending between said frame members, wherein said rail presents a first rail supporting said first door and a second rail supporting said second door, and said end walls present a first end wall and a second end wall, wherein said first rail extends between said first end wall and said center wall and said second rail extends between said second end wall and said center wall.

8. The gate of claim 1, wherein said doors present leading edges which are adjacent when said doors are in said closed position, and wherein said side walls present first and second sections which are joined at a location that is aligned with said leading edges when said doors are in said closed position.

9. The gate of claim 8, wherein said first and second sections are joined by welding.

10. The gate of claim 8, wherein a cover extends between opposite walls and overlies said leading edges when said doors are in said closed position.

11. The gate of claim 1, wherein said bottom opening presents first and second discharge outlets, wherein said end walls present first and second end walls, wherein said gate further comprises first and second dividing walls extending between said side walls, each dividing wall presents a mating surface and opposes one of said end walls, wherein said side walls, said first end wall, and said first dividing wall present said first discharge outlet, wherein said side walls, said second end wall, and said second dividing wall present said second discharge outlet, and wherein said first door blocks said first discharge outlet when in its closed position and said second door blocks said second discharge outlet when in its closed position.

12. The gate of claim 11, wherein a plurality of fasteners join said mating surfaces.

13. The gate of claim 11, further comprising first and second frame members, each of which supports and is joined with one of said side walls, a first center frame supporting and joined with said first dividing wall, and a second center frame supporting and joined with said second dividing wall, wherein said first and second center frames extend between said frame members, wherein said rail presents a first rail supporting said first door and a second rail supporting said second door, wherein said first rail extends between said first end wall and said first center frame and said second rail extends between said second end wall and said second center frame.

14. The gate of claim 1, wherein said rail extends in a direction parallel to the direction of movement of said doors.

15. The gate of claim 14, wherein said rail extends between said end walls.

16. The gate of claim 1, wherein a rod is mounted on top of said rail.

17. The gate of claim 1, wherein three rails extend between opposite walls adjacent said bottom opening, said rails supporting said first and second doors.

18. A hopper car gate for discharging cargo from a hopper car, said car comprising a hopper having an opening and a rim surrounding said opening, said gate comprising:

opposed generally upright side walls;

opposed generally upright end walls joined to said side walls, wherein said joined walls present a top opening and a bottom opening;

a flange joined with said side and end walls adjacent said top opening and adapted to be joined to the rim of the car;

first and second doors moveable in a generally horizontal plane in opposite directions between a closed position which blocks said bottom opening and an open position which allows the cargo to exit through said bottom opening;

means for supporting said first and second doors;

means for moving said first and second doors between their closed and open positions; and first and second sockets, each of which is coupled with said moving means, wherein said first and second doors move when said first and second sockets, respectively, are rotated.

19. The gate of claim 18 wherein said support means comprises a rail extending between opposite walls adjacent said bottom opening.

20. A hopper car gate for discharging cargo from a hopper car, said car comprising a hopper having an opening and a rim surrounding said opening, said gate comprising:

opposed generally upright side walls;

opposed generally upright first and second end walls joined to said side walls, wherein said joined walls present a top opening and a bottom opening comprising first and second discharge outlets;

first and second dividing walls extending between said side walls, each dividing wall presenting a mating surface and opposing one of said end walls, wherein said side walls, said first end wall, and said first dividing wall present said first discharge outlet, and wherein said side walls, said second end wall, and said second dividing wall present said second discharge outlet;

a flange joined with said side and end walls adjacent said top opening and adapted to be joined to the rim of the car;

a rail extending between opposite walls adjacent said bottom opening; and first and second doors supported on said rail, said doors moveable in opposite directions between a closed position which blocks said bottom opening and an open position which allows the cargo to exit through said bottom opening, wherein said first door blocks said first discharge outlet when in its closed position and said second door blocks said second discharge outlet when in its closed position.

21. A hopper car gate for discharging cargo from a hopper car, said car comprising a hopper having an opening and a rim surrounding said opening, said gate comprising:

opposed generally upright side walls;

opposed generally upright first and second end walls joined to said side walls, wherein said joined walls present a top opening and a bottom opening;

first and second frame members each of which supports and is joined with one of said side walls, and a center wall extending between said frame members;

a flange joined with said side and end walls adjacent said top opening and adapted to be joined to the rim of the car;

first and second rails, said first rail extending between said first end wall and said center wall adjacent said bottom opening, and said second rail extending between said second end wall and said center wall adjacent said bottom opening; and first and second doors each supported on one of said first and second rails, said doors horizontally slideable on said rails in opposite directions between a closed position which blocks said bottom opening and an open position which allows the cargo to exit through said bottom opening.

* * * * *